US008082754B2

(12) United States Patent
Kazazian

(10) Patent No.: US 8,082,754 B2
(45) Date of Patent: Dec. 27, 2011

(54) JEWELRY FRAGRANCE DISPENSER

(76) Inventor: Talyn Kazazian, Campbellville (CA)

( * ) Notice: Subject to any disclaimer, the term of this patent is extended or adjusted under 35 U.S.C. 154(b) by 255 days.

(21) Appl. No.: 12/434,547

(22) Filed: May 1, 2009

(65) Prior Publication Data

US 2009/0272146 A1 Nov. 5, 2009

Related U.S. Application Data

(60) Provisional application No. 61/050,062, filed on May 2, 2008.

(51) Int. Cl.
*A44C 13/00* (2006.01)

(52) U.S. Cl. ..... 63/1.15; 63/1.14; 63/15; 239/153; 239/289

(58) Field of Classification Search ..... 63/1.14, 63/1.15; 222/402.1, 402.23, 527, 533; 239/153, 239/289

See application file for complete search history.

(56) References Cited

U.S. PATENT DOCUMENTS

| | | | | | |
|---|---|---|---|---|---|
| 1,257,848 | A | * | 2/1918 | Griffin | 63/1.15 |
| 1,673,617 | A | | 6/1928 | Clark | |
| 2,234,062 | A | * | 3/1941 | Roberts | 63/1.15 |
| D140,109 | S | | 1/1945 | Pierce | |
| 3,270,525 | A | * | 9/1966 | Sellers | 63/1.15 |
| 3,331,559 | A | | 7/1967 | Fedit | |
| 3,353,749 | A | * | 11/1967 | Lahaug | 239/154 |
| 3,952,917 | A | | 4/1976 | Gause | |
| 4,023,712 | A | | 5/1977 | Babiak et al. | |
| 4,135,645 | A | | 1/1979 | Kimmell | |
| 4,159,631 | A | | 7/1979 | Lee | |
| 4,785,642 | A | | 11/1988 | Chin et al. | |
| 4,964,570 | A | | 10/1990 | Haiduk | |
| 4,972,684 | A | | 11/1990 | Aitken | |
| 5,217,143 | A | * | 6/1993 | Aitken | 222/78 |
| 5,316,182 | A | | 5/1994 | Lee et al. | |
| 5,492,248 | A | | 2/1996 | Ortner | |
| 6,123,228 | A | | 9/2000 | Hippensteel | |
| 6,135,321 | A | | 10/2000 | Hippensteel | |
| 6,644,513 | B1 | * | 11/2003 | Nesbitt | 222/175 |
| 2002/0084289 | A1 | * | 7/2002 | Stern et al. | 222/402.1 |
| 2005/0051578 | A1 | * | 3/2005 | Bonham | 222/153.11 |
| 2005/0173465 | A1 | * | 8/2005 | Roden | 222/402.1 |
| 2006/0011665 | A1 | * | 1/2006 | Garner | 222/402.1 |
| 2006/0081659 | A1 | * | 4/2006 | Walker | 222/402.1 |
| 2007/0158455 | A1 | | 7/2007 | Robbins-Sullivan | |
| 2008/0236195 | A1 | * | 10/2008 | Woebke | 63/1.14 |

* cited by examiner

*Primary Examiner* — Jack Lavinder
*Assistant Examiner* — Emily Morgan
(74) *Attorney, Agent, or Firm* — Conley Rose, P.C.; Rodney B. Carroll

(57) ABSTRACT

A piece of jewelry to be worn by a wearer, having a spray mechanism mounted on the piece of jewelry, and a reservoir for containing a fluid mounted on the piece of jewelry, to dispense a fluid, such as a fragrance or scent, to the body of the wearer. The manipulation of the reservoir by the wearer actuates the spray mechanism and dispenses fluid from the reservoir.

9 Claims, 3 Drawing Sheets

JEWELRY FRAGRANCE DISPENSER

CROSS-REFERENCE TO RELATED APPLICATIONS

The present application claims priority to U.S. Provisional Patent Application 61/050,062 filed May 2, 2008 by Talyn Kazazian, et al. and entitled "Jewelry Fragrance Dispenser," which is incorporated herein by reference as if reproduced in its entirety.

FIELD OF THE INVENTION

The present invention relates to a fragrance dispenser, and more particularly for dispensing a fluid, such as a scent or fragrance, from a fluid dispenser integrally located on a piece of jewelry.

BACKGROUND OF THE INVENTION

It is a common practice for individuals to apply fragrance or perfume to themselves, their clothing or their environment, as part of a personal hygiene regime. The rapid dissipation and evaporation of a fragrance after first application on a wearer's body requires re-application of the fragrance by the wearer. A person can carry a fragrance bottle for re-application throughout the day; however, this method can be inconvenient and cumbersome. A separate container is required to hold the fragrance, which must be carried by the wearer. There is a need for a convenient and attractive means of re-application of a fragrance.

In response to this problem, a number of arrangements have been disclosed which provide for personal jewelry that dispenses a fragrance. The principal benefit of jewelry that dispenses a fragrance is that the user is not required to carry a separate fragrance bottle or other dispenser in order to reapply a fragrance.

Some arrangements permit constant emissions of the fragrance from the personal jewelry, generally through diffusion of a scent through openings in the jewelry over time. Other arrangements include outlets which permit the slow dissemination of a fragrance from a reservoir to the body part in contact with the jewelry. These arrangements can be problematic, however. They typically do not permit the wearer to apply or re-apply the fragrance on the wearer's body. In addition, there is little control over the rate at which the fragrance is diffused, which may result in the scent being either too weak or too strong. The wearer cannot control the intensity of the fragrance or apply the fragrance upon demand.

There are a number of designs which require the removal of a control element to permit application of a fragrance on the body by the wearer, or to control the rate of diffusion of the constantly fragrance-emitting jewelry. However, the use of the removable element to apply a fragrance can be awkward for a number of reasons. The control elements tend to be quite small, and generally comprise small pins or rods. These can be difficult to manipulate, and may be easily lost by the wearer.

The use of a spray pump in a fluid dispenser to permit application of a fragrance on the body is known in the art. U.S. Pat. No. 4,023,712 discloses a spray container device for spraying sprayable compositions which is suspended around a wearer's neck. Such arrangements utilize a fluid dispenser with spray pump, however, the fluid dispenser does not form an integral part of the jewelry, and comprises a cap or lid which may be lost. U.S. Pat. No. 5,217,143 discloses an actuator mechanism for a fluid dispenser using a spray pump incorporated into a bangle, however, this arrangement is not easily or readily transferrable to other forms of jewelry.

It is desirable to provide a spray fluid dispenser in the form of a jewel, which can be incorporated into jewelry. This permits the use of a jewel shaped fluid dispenser in the production of diverse jewelry pieces, such as rings, earrings, brooches, pendants and the like.

SUMMARY OF THE INVENTION

It is an object of the invention to provide a spray fluid dispenser integrally located on a piece of jewelry containing a detachable jewel-shaped reservoir containing fluid, where manipulation of the reservoir actuates the spray mechanism and dispenses fluid, such as a fragrance or scent, from the reservoir.

A preferred embodiment of this invention consists of a piece of jewelry to be worn by a wearer, including, a ring, pendant for a necklace, or as an earring. A reservoir for containing a fluid is in fluid communication with a spray mechanism and both are mounted on the piece of jewelry. The reservoir containing a fluid is detachable and shaped as a jewel.

Manipulation of the reservoir by the wearer actuates the spray mechanism and dispenses fluid from the reservoir. Manipulation of the reservoir to actuate the spray mechanism may occur by depressing the reservoir towards the piece of jewelry, torsion or rotation of the reservoir relative to the piece of jewelry, or extension of the reservoir from the piece of jewelry.

The spray mechanism comprises a pump and fluid travels through a conduit or channel within the piece of jewelry before being dispensed.

BRIEF DESCRIPTION OF THE FIGURES

The invention may be understood with reference to the accompanying figures, where.

DETAILED DESCRIPTION OF THE INVENTION

Figure 1:
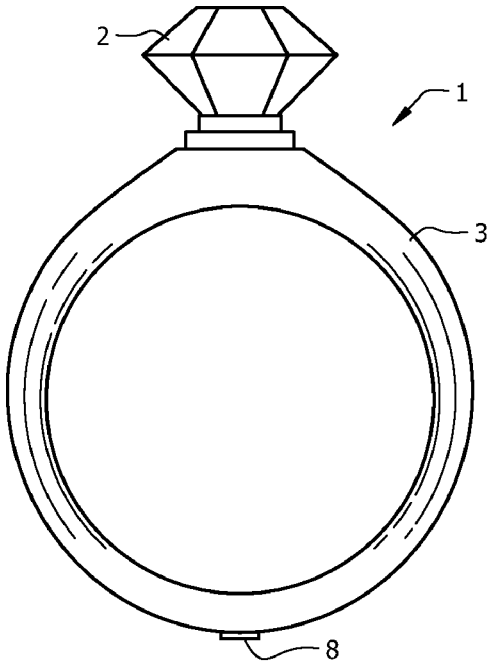
FIG. 1 is a side view of one embodiment of the invention as implemented in a ring.
Figure 3:
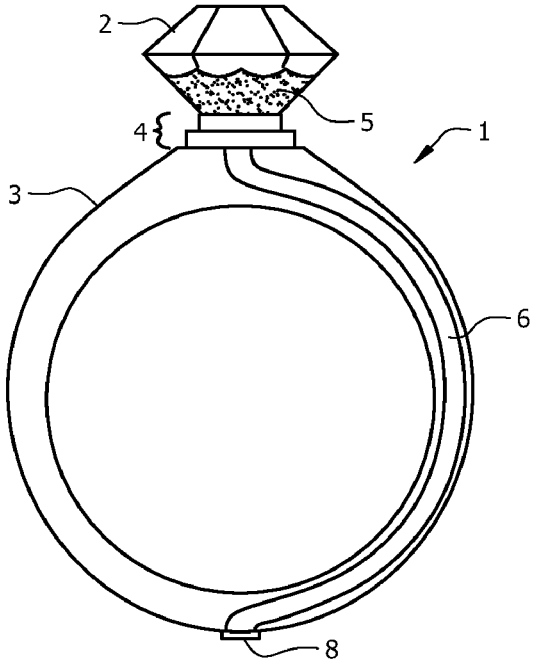
FIG. 3 is a side view of the embodiment of FIG. 1 cut away to depict a conduit.

In the preferred embodiment shown in FIGS. 1 and 3, a ring 1 of conventional shape may have a reservoir 2 and a band 3 containing a spray mechanism 4. The spray mechanism 4 may contain a conduit 6 which may pass internally through the ring 1, beginning at the reservoir 2, through the band 3 and ending at a nozzle 8. When the reservoir 2 is manipulated by the user, a fluid 5, such as a perfumed gas or liquid, contained in the reservoir 2 passes through a conduit 6 and exits the band 3 through the nozzle 8. The manipulation of the reservoir 2 may activate the spray mechanism 4 by dispensing the fluid 5 in the reservoir 2. The fluid 5 may be released or pumped by the spray mechanism 4. In the case of a pump, a pump of positive displacement design may be used to draw fluid 5 from the reservoir 2 and dispense it from the nozzle 8 under pressure.

The band 3 may be comprised of any material, including a resin, plastic, or metal, such as gold, silver and stainless steel, or any composite material comprising a plastic or metal with other material. The band 3 may be made of more than one component designed to be bound or fixed together to form ring 1 having a conduit 6 or other channel.

Figure 2:
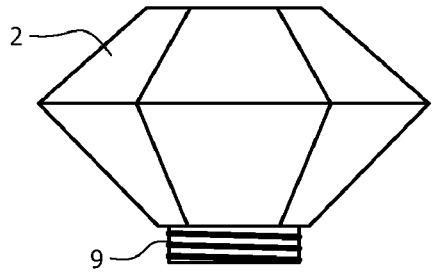
FIG. 2 is a side view of a detachable reservoir in accordance with one embodiment of the invention.

FIG. 2 shows the reservoir 2 having a threaded surface 9 to connect the reservoir 2 to the band 3. This permits the wearer to refill the reservoir 2 with fluid 5. The fluid 5 may have a scent or fragrance.

Figure 4:
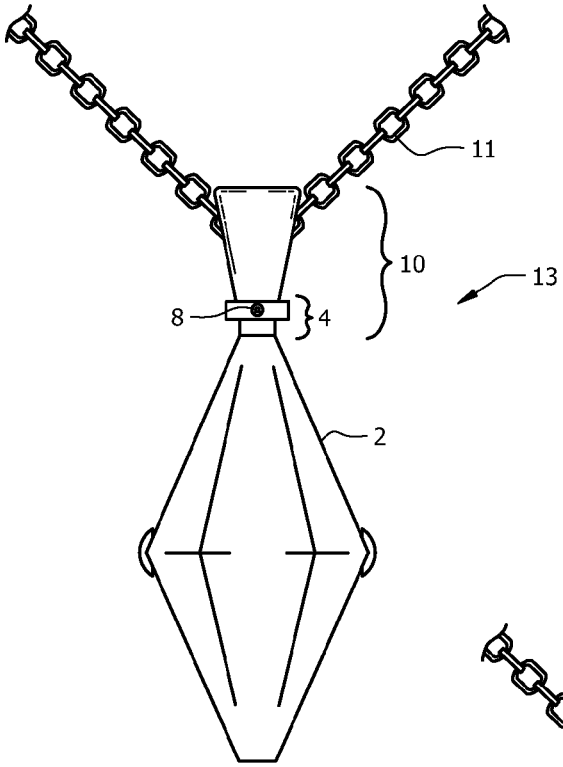
FIG. 4 is a side view of a second embodiment of the invention as implemented in a pendant.
Figure 5:
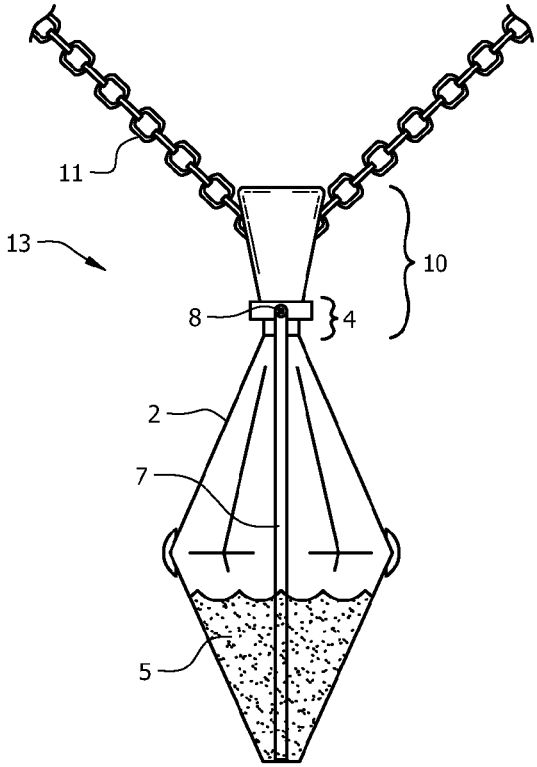
FIG. 5 is a side view of the embodiment of FIG. 4 cut away to depict a siphon.

In a second embodiment shown in FIGS. 4 and 5, a pendant 13 has a reservoir 2 and an assembly 10. The pendant 13 may be suspended from a necklace 11, or may form part of a necklace 11, to be worn around the neck of a user. The assembly 10 may be in any shape, and may comprise a loop or other element designed to couple the assembly 10 to the necklace 11. The spray mechanism 4 contains a siphon 7 which draws fluid 5 from the reservoir 2. The fluid 5 is dispensed from a nozzle 8. When the reservoir is manipulated, the fluid 5 contained in the reservoir 2 passes through the siphon 7 and exits through the nozzle 8.

The assembly 10 may be comprised of any material, including a resin, plastic, or metal, such as gold, silver and stainless steel, or any composite material comprising a plastic or metal with other material. The assembly 10 may be made of more than one component designed to be bound or fixed together to form assembly 10 having a siphon 7 or other channel.

The necklace 11 may be comprised of any material, including a resin, plastic, or metal, such as gold, silver and stainless steel, or any composite material comprising a plastic or metal with other material.

Figure 6:
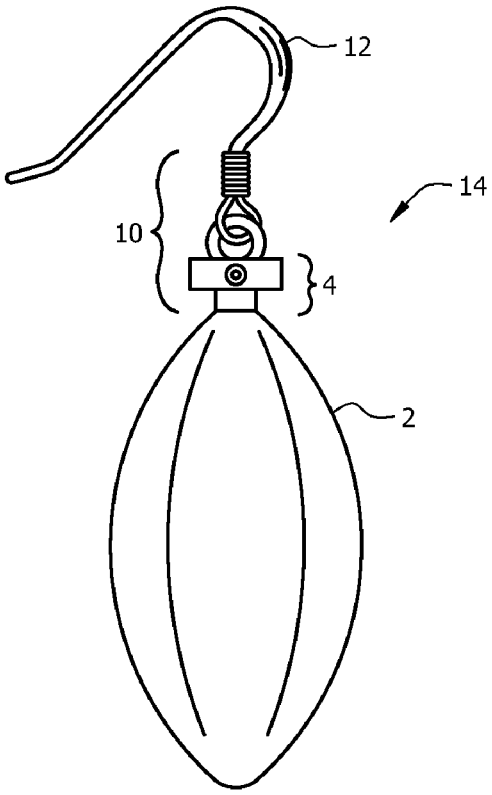
FIG. 6 is a side view of a third embodiment of the invention implemented as an earring.
Figure 7:
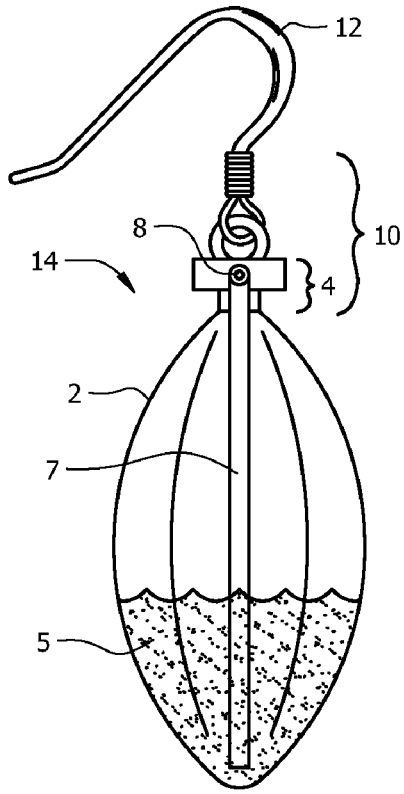
FIG. 7 is a side view of the embodiment of FIG. 6 cut away to depict a siphon.

In the third embodiment shown in FIGS. 6 and 7, the assembly 10 is adapted to hang from a wearer's ear such that the entire device operates as an earring 14. The assembly 10 has ear fastener 12 coupled to it. The ear fastener 12 may be any common type of ear fastener, but preferably fishhooks, hoops, kidney wire, lever back and ball on post with ring. The assembly 10 and ear fastener 12 may be comprised of any material, including gold, silver and stainless steel, or composites of plastic and metal. The earring 14 may be made of lightweight materials to reduce strain on a wearer's earlobe.

The earring 14 has a reservoir 2 and an assembly 10. The assembly 10 may be in any shape to accommodate the spray mechanism 4 and reservoir 2. The spray mechanism 4 contains a siphon 7 which draws fluid 5 from the reservoir 2. The fluid 5 is dispensed from a nozzle 8. When the reservoir 2 is manipulated, the fluid 5 contained in the reservoir 2 passes through the siphon 7 and exits through the nozzle 8.

In any embodiment, the manipulation of the reservoir 2 may be by rotating the reservoir 2 relative to the assembly 10 or the ring 1. The manipulation may be by extension of the reservoir 2 away from the assembly 10 or the ring 1, or depression of reservoir towards the assembly 10 or the ring 1. The manipulation of the reservoir actuates the spray mechanism 4 to dispense fluid 5. This may be by a pumping of the fluid 5 from the reservoir 2 by reciprocating or rotary displacement pumps, such as a plunger or diaphragm pump, or a screw or lobe pump.

In any embodiment, the reservoir 2 may be formed into any shape colour and size, including round, angular, rectangular and multi-faceted. The reservoir 2 may be comprised of any material including glass, plastic, or crystal.

It will be appreciated that the above description relates to the preferred embodiments by way of example only. Many variations on the method and system for delivering the invention will be clear to those knowledgeable in the field, and such variations are within the scope of the invention as claimed, whether or not expressly described.

What is claimed is:

1. A ring to be worn by a wearer, comprising:

a) a band containing a conduit having first and second ends, the conduit adapted to permit fluid to pass therethrough, the second end of the conduit comprising a nozzle positioned and adapted to allow fluid in the conduit to exit the band;

b) a spray mechanism mounted on an outer circumference of the band, the spray mechanism being in fluid communication with the first end of the conduit, and spaced apart from the nozzle; and c) a jewel-shaped reservoir adapted to contain a fluid, the reservoir connected to the spray mechanism and in fluid communication with the spray mechanism;

wherein manipulation of the reservoir by the wearer actuates the spray mechanism and dispenses the fluid from the reservoir through the conduit and out the nozzle.

2. The ring of claim 1, wherein the manipulation of the reservoir comprises depressing the reservoir towards the band.

3. The ring of claim 1, wherein the manipulation of the reservoir comprises rotating the reservoir relative to the band.

4. The ring of claim 1, wherein the manipulation of the reservoir comprises extending the reservoir from the band.

5. The ring of claim 1, wherein the reservoir is detachable from the spray mechanism.

6. The ring of claim 5, wherein the reservoir is threaded to connect the reservoir to the spray mechanism.

7. The ring of claim 1, wherein the spray mechanism comprises a pump that draws fluid from the reservoir and pumps the fluid under pressure through the conduit and out the nozzle.

8. The ring of claim 7, wherein the spray mechanism comprises a positive-displacement pump.

9. The ring of claim 1, wherein the nozzle is mounted at a location on the band opposite the reservoir.

* * * * *